United States Patent [19]

Lamy

[11] 4,114,392

[45] Sep. 19, 1978

[54] PLATFORM STRUCTURE FOR MARITIME INSTALLATIONS

[75] Inventor: Jacques Edouard Lamy, Fontenay-aux-Roses, France

[73] Assignee: Compagnie Generale pour les Developpements Operationnels des Richesses Sous-Marines "C. G. Doris", Paris, France

[21] Appl. No.: 809,897

[22] Filed: Jun. 24, 1977

[30] Foreign Application Priority Data

Jun. 24, 1976 [FR] France ..... 76 19227

[51] Int. Cl.[2] ..... E02B 17/00

[52] U.S. Cl. ..... 405/207; 405/205

[58] Field of Search ..... 61/101, 100, 97, 92, 61/91, 90, 86; 166/.5, .6

[56] References Cited

U.S. PATENT DOCUMENTS

| | | | |
|---|---|---|---|
| 1,868,494 | 7/1932 | Collins | 61/86 |
| 3,738,113 | 6/1973 | Madary et al. | 61/101 |
| 4,014,177 | 3/1977 | Jarlan | 61/101 X |
| 4,019,332 | 4/1977 | Lamy | 61/86 |

*Primary Examiner*—Dennis L. Taylor
*Attorney, Agent, or Firm*—Wigman & Cohen

[57] ABSTRACT

An off-shore gravity type platform for supporting a processing installation above the surface of a body of water and for housing processing components, comprising a pressure-resisting watertight central shaft extending from top to bottom of the platform structure, the lower end of the shaft being surrounded by a coffered base structure with a protective wall surmounted by pillars co-operating with the shaft for supporting a bridge, the shaft being so sized that the platform has a positive buoyancy, the top of the protecting wall being located below the level of the body of water, and the pillars being hollow and being filled with concrete after the platform is in place.

4 Claims, 4 Drawing Figures

PLATFORM STRUCTURE FOR MARITIME INSTALLATIONS

The present invention relates to a platform for "off-shore" operations, designed to carry industrial installations such as drill rigs or petroleum production plants, power stations (electrical or other types) or again scientific installations, for example, for oceanographic or meteorological purposes. The invention relates more particularly to a platform of the so-called "gravity platform" type which rests upon the sea bed through the medium of a heavy base forming the foot of a tower surmounted by a superstructure emerging above the water. Such a platform is commonly made of prestressed reinforced concrete, being built partially on land and partially at sea at a sheltered location of adequate depth. After the completion and assembly of the equipment, the platform is towed to its final site of erection where it is submerged so that it rests upon the sea bed heavily, if required being ballasted down by the use of gravel or the like.

U.S. Pat. No. 3,938,343 describes a platform having a structure which incorporates a pressure-resisting, watertight barrel which does duty as a hollow shaft extending from top to bottom of the structure and which can be kept dry, the barrel being more particularly designed to protect the piping arrangements, machinery or other essential elements of the installation, so that they are not affected by marine corrosion and are also protected against shock loading, this system furthermore making it possible to carry out, in a dry environment, various maintenance, inspection and other operations etc, required by the process for which the platform is being used.

The lower end of the barrel is surrounded by a coffered base structure extending to an upper apertured wall which emerges from the sea and is topped by pillars, the bridge of the platform being supported by said pillars and the central barrel.

The apertured wall is provided, on one hand, for protecting the central barrel from the sea in case of heavy weather and, on the other hand, for acting as an auxiliary buoyancy means as the platform is towed onto its site of erection. To this end, the apertures of the wall are temporarily plugged and sometimes even the spacings between the pillars are plugged, thus allowing the platform to float. When the platform arrives to its destination, the apertures and the spacings are cleared and the platform sinks.

Such a wall has the disadvantage of increasing the swell drag of the platform.

The object of the present invention is to meet with this difficulty. To this end, the central barrel is so sized that the platform has a positive buoyancy, which makes it possible to bring the platform in place without the necessity of using auxiliary buoyancy means, such as plugging the apertures or spacings, as hereabove mentioned.

For reducing the drag, the top of the wall may be also located far below the level of the sea. The wall may even be omitted and, in this case, the pillars supporting the bridge extend to the coffered base structure.

According to the invention, the strain due to the swell is reduced by reducing the front of the obstacles and the platform is submerged by a simple method without complicated differential ballasting.

The invention will now be described by way of example with reference to the accompanying drawings in which.

Figure 1:
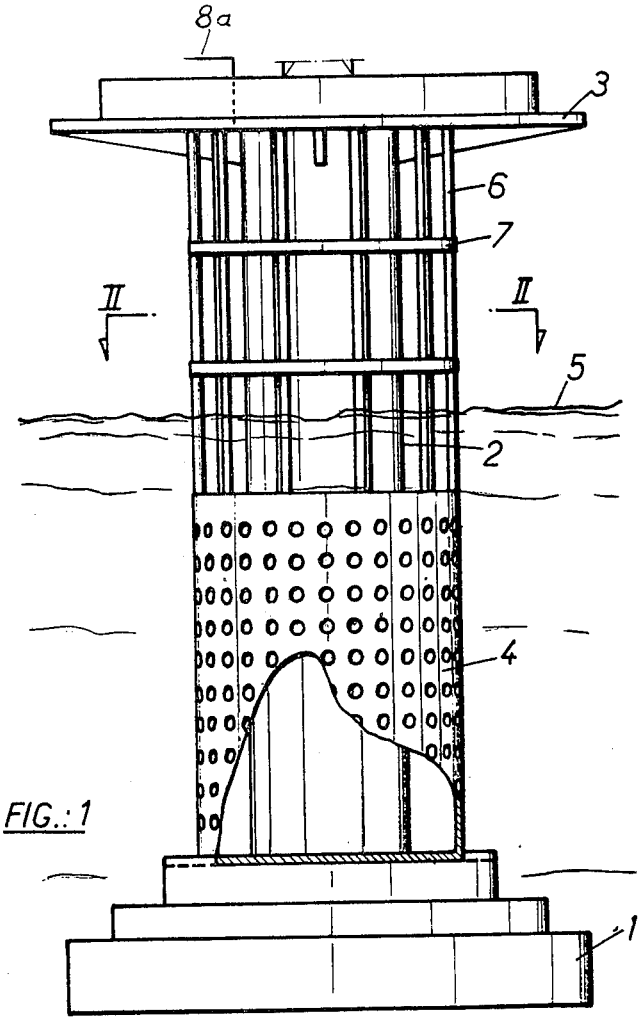
FIG. 1 is a diagrammatic elevation view of a platform according to the present invention.
Figure 2:
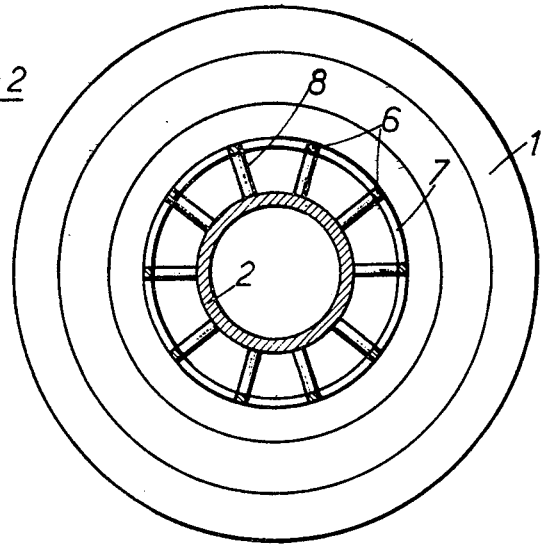
FIG. 2 is a section along II—II of FIG. 1.

The platform shown in FIGS. 1 and 2 comprises, as the platform described in the above-mentioned patent specification, a coffered structure 1 surmounted by a central barrel 2 locked to the bridge 3 of the platform.

The sizes of the structure 1 and of the barrel 2 are such that the platform when non-ballasted has a positive buoyancy. Thus, the height of the protecting wall 4, which is erected above the structure around the barrel 2, may be reduced to such an extent that its top is located far below the lowest level 5 of the surface of the water in which the platform is erected. The wall 4 may be apertured or not.

The bridge 3 is also supported by means of pillars 6 spaced regularly around the periphery of the wall 4, said pillars being cross-braced by means of rings 7 and preferably also by means of struts 8, e.g., radial struts, connecting the pillars to the central barrel.

Such struts can be used for creating an encastre securing of the pillars under the ridge, if the securing of the latter is not sufficient.

By way of example, good results are obtained by choosing for the barrel a diameter of 20–30 meters with a maximum diameter of 80–120 meters for the structure 1.

Figure 3:
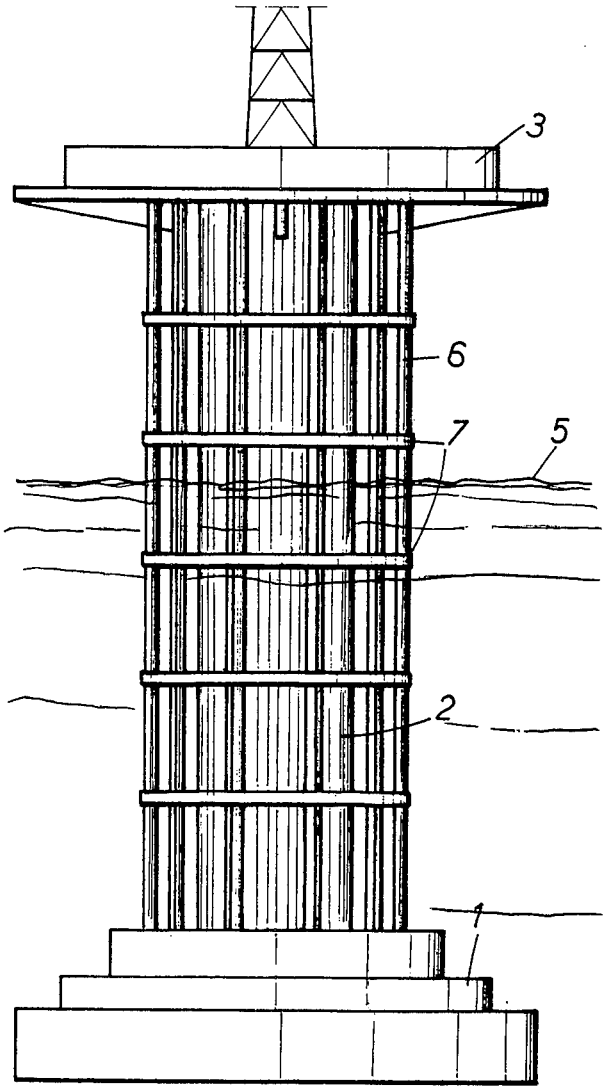
FIG. 3 is a similar view of another embodiment according to the invention.

In FIG. 3, the wall 4 has been omitted and the pillars extend from the structure 1 to the bridge 3, reinforcing rings 7 being provided at regular spacings as well as struts if required.

Figure 4:
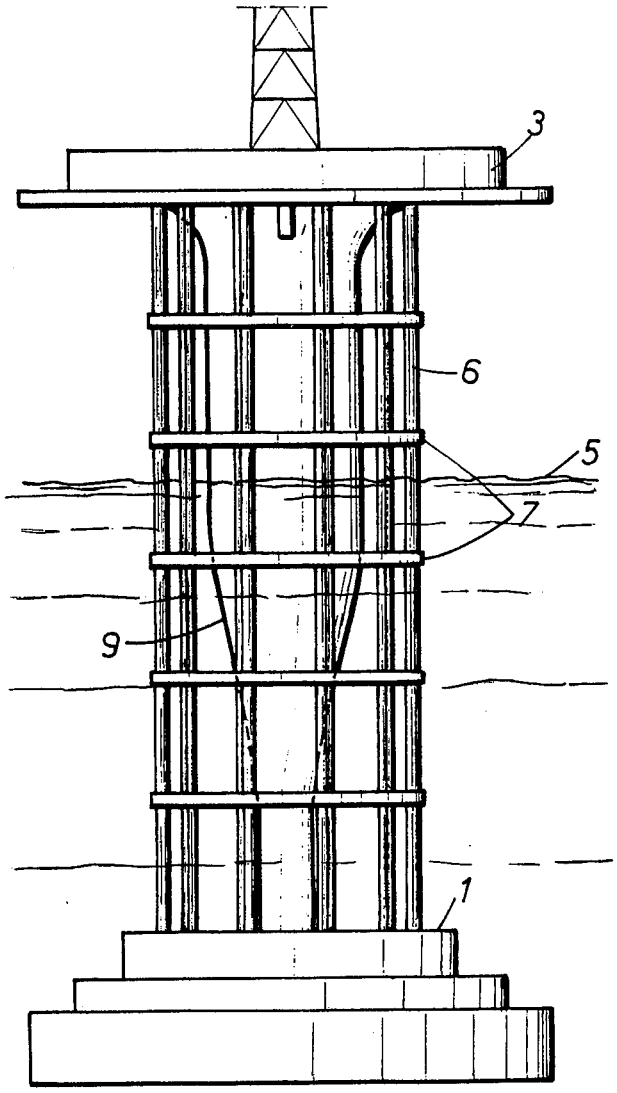
FIG. 4 is a view similar to FIG. 3, showing a modification of the invention.

FIG. 4 shows an embodiment in which the barrel 2 of FIG. 3 which has a constant cross-section along its length, has been modified to a barrel 9 having an outline which is narrowed at the foot and flared at the top in the shape of a horn. It will be appreciated that barrel 9 further reduces the drag of the platform and makes its towage easier.

In the various embodiments hereabove described, the pillars 6 are generally made of steel or concrete and may be hollow or solid. By way of example, they may be hollow, then filled with concrete, as through piping such as 8a (FIG. 1), after the platform is erected. With pillars having a diameter ranging from about one to three meters, for example, the buoyancy gain obtained is not negligible. Generally, the platform arrives with its bridge positioned and a part of the useful loads. The proper time at which the pillars are filled is chosen by taking into consideration the load balance.

While the invention has been particularly shown and described with reference to preferred embodiments thereof, it will be understood that various changes in form and detail may be made without departing from the scope of the invention.

I claim:

1. An off-shore gravity type platform for supporting a processing installation above the surface of a body of water and for housing processing components, comprising a coffered base structure for resting upon the bed of the body of water; a pressure-resisting watertight hollow shaft integrally connected to the base structure to be supported by the same and extending therefrom up to above said water surface a protective wall around a foot portion of the shaft, integrally connected to the base structure to be supported by the same and having a height substantially less than the depth of said body of water; a plurality of hollow pillars supported by the protective wall and extending therefrom up to above said water surface; a bridge supported on the upper ends of said hollow shafts and said hollow pillars; and means for filling the pillars with concrete; said base structure and said hollow shaft being so sized that the platform in an unballasted condition has a positive buoyancy.

2. A platform as claimed in claim 1, comprising rings and struts cross-bracing the pillars.

3. A platform as claimed in claim 2, wherein said struts create an encastre-securing of the pillar tops to the bridge.

4. A platform as claimed in claim 1, wherein said hollow shaft has such an outline that the shaft is narrowed towards its foot and flared towards its top.

* * * * *